United States Patent [19]

Sharma et al.

[11] Patent Number: 4,777,490

[45] Date of Patent: Oct. 11, 1988

[54] MONOLITHIC ANTENNA WITH INTEGRAL PIN DIODE TUNING

[75] Inventors: Arvind K. Sharma, Cranbury, N.J.; Paul J. Stabile, Langhorne, Pa.

[73] Assignee: General Electric Company, Schenectady, N.Y.

[21] Appl. No.: 859,032

[22] Filed: Apr. 22, 1986

[51] Int. Cl.[4] ..... H01Q 19/06

[52] U.S. Cl. ..... 343/754; 343/700 MS

[58] Field of Search ..... 343/700 MS, 754, 756, 343/909; 333/99 R, 246, 247

[56] References Cited

U.S. PATENT DOCUMENTS

| | | | |
|---|---|---|---|
| 3,416,042 | 12/1968 | Thomas et al. | 317/234 |
| 3,680,136 | 7/1972 | Collings | 343/746 |
| 4,053,895 | 10/1977 | Malagisi | 343/700 MS |
| 4,259,670 | 3/1981 | Schiavone | 343/700 MS |
| 4,367,474 | 1/1983 | Schaubert et al. | 343/700 MS |
| 4,379,296 | 4/1983 | Farrar et al. | 343/700 MS |
| 4,382,261 | 5/1983 | Freibergs et al. | 343/854 |
| 4,475,108 | 10/1984 | Moser | 343/700 MS |
| 4,490,721 | 12/1984 | Stockton et al. | 343/368 |
| 4,491,977 | 1/1985 | Paul | 455/327 |
| 4,529,987 | 7/1985 | Bhartia et al. | 343/700 MS |
| 4,568,889 | 2/1986 | Bayraktaroglu | 333/247 |

OTHER PUBLICATIONS

An Article Entitled "Optical Control of Microwave PIN Diode and its Applications" by Sykes et al. Presented at the Benjamin Franklin Symposium in Philadelphia in May 1985.

*Primary Examiner*—Theodore M. Blum

*Attorney, Agent, or Firm*—Henry I. Steckler; James C. Davis, Jr.; Paul R. Webb, II

[57] ABSTRACT

Antennas chiefly intended for microwave and millimeter-wave use include geometric-shaped conductive patches on one broad surface of a planar semiconductor substrate. The other broad side of the substrate bears a conductive ground plane. Monolithic PIN diodes are formed by doping the substrate at various points between the conductive patch and the ground plane. Biasing arrangements affect the conduction of the PIN diodes thereby affecting or tuning the optimum operating frequency, the radiation pattern, and/or the impedance of the antenna. In a particularly advantageous configuration, the PIN diodes have lateral dimensions greater than or equal to one-tenth wavelength ($\lambda/10$) at the operating frequency. Distributed diodes have lower resistance and reactance than discrete or discrete monolithic diodes, thereby providing improved radiating characteristics, and have a relatively large power-handling capability which makes them useful for power transmission.

8 Claims, 5 Drawing Sheets

MONOLITHIC ANTENNA WITH INTEGRAL PIN DIODE TUNING

This invention relates to antennas formed on semiconductor substrates with integral or monolithic pin diodes for adjustment or tuning.

BACKGROUND OF THE INVENTION

Modern electromagnetic communication and remote sensing systems are using increasingly high frequencies. Higher frequencies more readily accommodate the large bandwidths required by modern high data rate communications and such sensing arrangements as chirp radar. Also, at high frequencies the physical size of an antenna required to produce a given amount of gain is smaller than at lower frequencies. Some high frequencies are particularly advantageous or disadvantageous because of the physical transmission properties of the atmosphere at the particular frequency. For example, communications are disadvantageous at 23 GHz because of the high path attenuation attributable to atmospheric water vapor, and at 55 GHz because of oxygen molecule absorption. On the other hand, frequencies near 40 GHz are particularly advantageous for communication and radar purposes in regions subject to smoke and dust because of the relatively low attenuation at those frequencies. When a high gain antenna array is required, it is advantageous for each antenna element of the array to have physically small dimensions in the arraying direction. For example, if it is desired to have a rectangular planar array of radiating elements for radiating in a direction normal or orthogonal to the plane of the array, it is desirable that the physical dimensions of each antenna element in the plane of the array be small so that they may be closely stacked. For those situations in which an antenna array uses a large number of radiating elements, it is also desirable that the radiating elements be substantially identical so that the radiation patterns attributable to each radiating element are identical. It is difficult to generate large amounts of radio frequency (RF) energy at microwave frequencies (roughly 3 to 30 GHz) and at millimeter wave frequencies (roughly in the range of 30–300 GHz), and the losses attributable to transmission lines and to other elements tend to be quite high at such frequencies. These considerations tend to reduce the power available for radiation by an antenna. Good engineering design, such as the minimization of transmission line path lengths, can maximize the power available for radiation from an antenna. It may be desirable, however, to tune the antenna either to maximize radiated power or to allow the antenna to operate efficiently at various frequencies within an operating frequency range.

Antennas in the form of a rectangular conductive patch separated by a layer of dielectric material from a ground plane are known to provide certain advantages for microwave and millimeter wave operation. These advantages include relative ease of manufacture to tight tolerances by photographic techniques and corresponding low cost, reasonable impedance match, and for some configurations selectable circular polarization. Furthermore, such antennas are readily driven by strip transmission lines formed on the dielectric substrate. It is known to adjust the frequency and performance of such patch antennas, as described in U.S. Pat. No. 4,367,474 issued Jan. 4, 1983 in the name of Schaubert et al. The Schaubert et al. arrangement describes the placing of conductive shorting posts in prepositioned holes extending between points on the patch antenna and a ground plane. Schaubert et al. also describe the replacing of the conductive shorting posts by switching diodes which are coupled to the ground plane by bypass capacitors and which are also coupled to an external bias circuit by radio frequency chokes. U.S. Pat. No. 4,379,296 issued April 5, 1983 to Farrar et al. is generally similar. Another prior art arrangement substitutes varactor or variable-capacitance diodes for the switching diodes, as described in U.S. Pat. No. 4,529,987 issued July 16, 1985 to Bhartia et al. At microwave and millimeter wave frequencies, the placement of the holes and the connections of the diodes and the necessary bias arrangments in the vicinity of the radiating portion of the antenna are subject to manufacturing tolerances which make it difficult to obtain reliable performance and which therefore increase the cost of manufacture of arrays which include multiple radiating elements. It is desirable to increase the reliability of performance of tuned antenna elements for reduction of cost of manufacture and for ease of arraying of the antennas.

SUMMARY OF THE INVENTION

An antenna includes a substantially intrinsic flat semiconductor substrate including first and second broad sides. A first region of the substrate adjacent the first broad side is heavily doped with one of n and p donor impurities to form one of an n+ and a p+ region. A second region of the substrate adjacent the second broad side is heavily doped with the other of the n and p donor impurities to form the other of the n+ and p+ regions. The second region is located on the substrate at a point opposite the first region. The doping depths of the first and second regions together are less than the thickness of the substrate, so that intrinsic semiconductor material separates the n+ and p+ regions, thereby defining a PIN diode including first and second electrodes. A first conductive layer is affixed to the first broad side of the semiconductor substrate and overlies the first region so as to be in conductive contact therewith. A second conductive layer is affixed to the second broad side of the semiconductor substrate overlying the second region and in conductive contact therewith. The first and second conductive layers are dimensioned relative to each other to define an antenna which, when energized at a frequency within a frequency band, radiates in preferred directions. A bias arrangement is coupled to the PIN diode for controlling the characteristics of the antenna.

DETAILED DESCRIPTION OF THE INVENTION

Figure 1A:
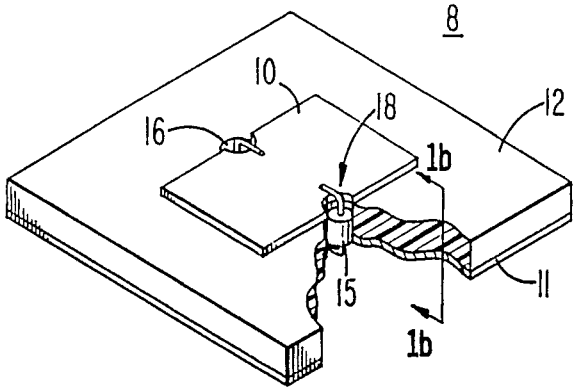
Fig. 1a PRIOR ART
FIG. 1*a* is a perspective view, partially cut away, of a patch antenna as in the prior art, together with its tuning diodes.
Figure 1B:
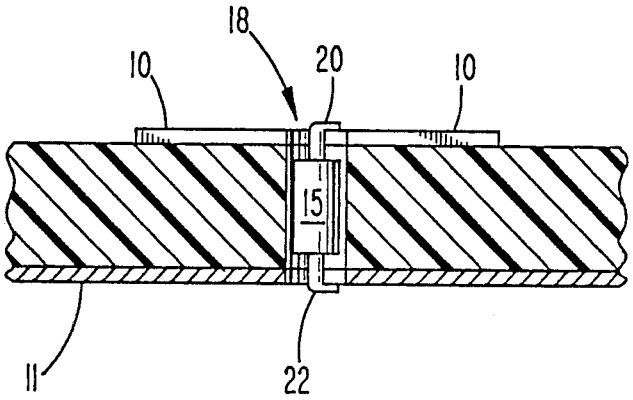
Fig. 1b PRIOR ART
FIG. 1*b* is a cross-sectional view of the prior art arrangement of FIG. 1*a;*

FIG. 1*a* illustrates a prior art patch antenna, generally as described in the aforementioned Bhartia et al. patent, cut away to illustrate the connections which must be made in such an arrangement. In FIG. 1*a*, an antenna designated generally as 8 in which the radiating element is a rectangular patch 10 of conductive material has patch 10 separated from a ground plane 11 by a thin dielectric layer 12. Such ground planes have linear dimensions at least double those of the radiating element, whereby the area of the ground plane is at least four times the area of the radiating element. In accordance with the invention described by Bhartia et al., the tunable bandwidth of the antenna is increased by the provision of a pair of diodes, one of which is illustrated as 15, connected between the edges of patch 10 and ground plane 11. One way to implement such an arrangement is to insert a discrete diode 15 having axial leads into a hole drilled or punched through dielectric plate 12 and ground plane 11 near the edge of patch 10. One such hole is illustrated as 16 in FIG. 1*a*, and the other hole through which diode 15 is inserted is partially cut away as viewed in FIG. 1*a* and is designated 18. FIG. 1*b* is a cross-section of the arrangement of FIG. 1*a* looking in the direction 1*b*–1*b*. As illustrated in FIG. 1*b*, the axial leads 20, 22 of diode 15 extend through hole 18, and are bent to make contact with conductive patch 10 and with conductive ground plane 11, respectively. The leads may be soldered or welded to patch 10 and to ground plane 11 as required to maintain good electrical contact.

An arrangement such as that illustrated in FIGS. 1*a* and 1*b* may be costly to manufacture. For example, when a plurality of conductive patches such as 10 are arrayed to form a multiple-antenna radiator, it is desirable that all of the antennas have the same radiating characteristics and the same impedance characteristics. The radiating and impedance characteristics of the antenna, however, depend upon the net reactances of the diodes such as diode 15, and on the location of the diodes relative to the radiating patch. These reactances and positions depend not only upon the position of the drilled holes such as hole 18, but also upon the location and orientation of the diode (such as diode 15) within the hole it occupies, the diameters of the leads 20 and 22, and even upon the exact location on patch 10 at which lead 20 is attached. The net reactance also depends upon the reactance of the various diodes under given bias conditions. If the diodes are not matched, their reactances under a particular bias condition (or lack thereof) will differ from unit to unit. It can be seen that great exactitude in the manufacturing process is required among the many antennas which may be used in an array, and in the selection of the appropriate diodes therefor.

Figure 2A:
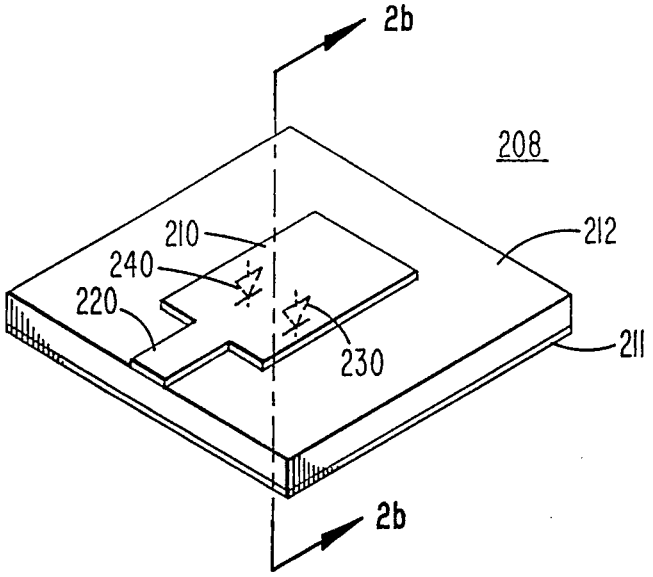
FIG. 2*a* is a perspective view of a patch antenna according to the invention.

Even when constructed, the prior art arrangement of necessity uses a limited number of diodes to perform the tuning or adjustment. Consequently, all of the current flow associated with a region of the surface of the patch is required to flow within the relatively small volume of the discrete diode. This results in a substantial $I^2R$ or heating losses which reduce the effective gain of the antenna. Furthermore, these heating losses stress the discrete diode and its connection to the adjacent antenna patch and the ground plane. This reduces the overall reliability of an antenna array fabricated from such antenna elements FIG. 2*a* is a perspective view of an antenna 208 according to the invention. Antenna 208 includes a radiating element in the form of a rectangular conductive patch 210 separated from a conductive ground plane 211 by a thin semiconductor layer 212. In accordance with the invention, the bandwidth or operating frequency of the antenna is adjusted by the provision of one or more monolithic PIN diodes connected between various points on conductive patch 210 and ground plane 211. Two such monolithic PIN diodes are illustrated in FIG. 2*a* as phantom diode symbols designated 230 and 240. As illustrated in FIG. 2*a*, patch 210 is coupled to a short portion of antenna feed microstrip line including an elongated conductive portion 220 spaced away from ground plane 211. Design of such microstrip transmission lines (sometimes known as striplines) is well known and is not described herein.

Figure 2B:
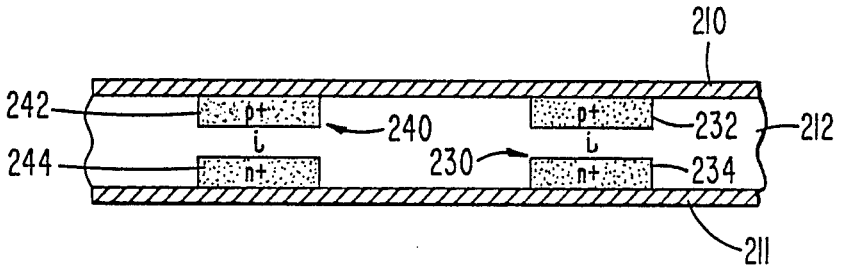
FIG. 2*b* is a cross-section of the antenna of FIG. 2*a* in a direction 2*b*—2*b;*

FIG. 2*b* is a cross-section of a portion of the arrangement of FIG. 2*a* taken in the direction of arrows 2*b*—2*b*. In FIG. 2*b*, elements corresponding to those of FIG. 2*a* are designated by the same reference numerals. In FIG. 2*b*, conductive patch 210 is seen in cross-section attached to an upper surface of semiconductor plate 212. Conductive ground plane 211 is attached to the bottom surface of semiconductor plate 212. The bulk of the semiconductor material is intrinsic (i). An intrinsic semiconductor is one which is substantially pure, or which includes few impurities which affect its conductivity. The semiconductor material may be silicon (Si), gallium arsenide (GaAs), or other semiconductor. Vertical PIN diodes 230 and 240 are seen in cross-section. PIN diode 230 includes a region 232 heavily doped with hole donor impurities (p+) so as to produce an ohmic contact area which is in intimate contact with conductive patch 210 so as to electrically connect conductive patch 210 to one electrode of PIN diode 230. Another portion 234 associated with the bottom surface of semiconductor plate 212 is heavily doped with electron donor impurities (n+) so as to produce an ohmic contact area which is in intimate contact with ground plane 211. The depth of dopings of regions 232 and 234 together constitute less than the thickness of semiconductor plate 212 so that p+ region 232 and n+ region 234 are everywhere separated by a layer of intrinsic (i) semiconductor which taken as a whole constitutes a vertical PIN diode 230.

Similarly, vertical PIN diode 240 is constituted by a p+ doped region 242 associated with the upper surface of semiconductor plate 212 and an n+ doped region 244 associated with the lower surface of semiconductor plate 212, separated from each other by an i region.

Figure 2C:
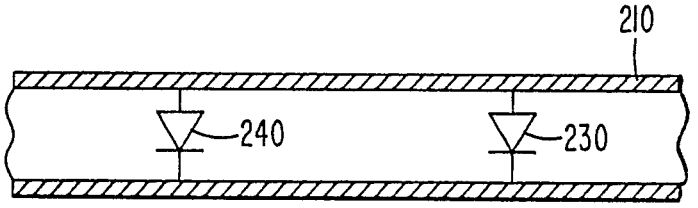
FIG. 2*c* is a cross-sectional view similar to FIG. 2*b* illustrating the equivalent circuit of the structure of FIG. 2*b;*

FIG. 2c is a cross-section similar to that of FIG. 2b illustrating by schematic diode symbols designated 230 and 240 the effective electrical circuits produced by the various dopings and connections illustrated in FIG. 2b.

Figure 3:
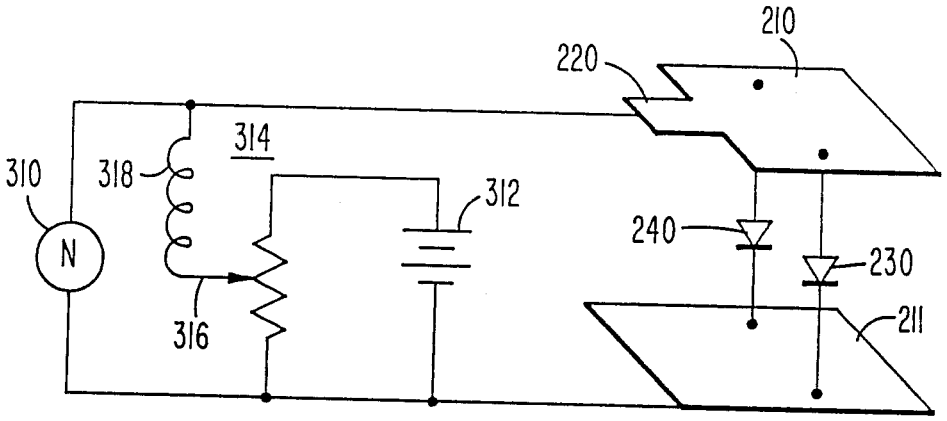
FIG. 3 is a diagram, partially in pictorial and partially in schematic form, illustrating the connections to the antenna illustrated in FIGS. 2*a* and 2*b* for radiating energy therefrom.

FIG. 3 illustrates, partially in pictorial and partially in schematic form, the electrical connections required to radiate signal from a tuned antenna according to the invention. Elements of FIG. 3 corresponding to elements of FIG. 2a are designated by the same reference number. In FIG. 3, a source 310 produces millimeter wave alternating (AC) signals which are applied by way of transmission line 220 to radiating patch 210 for producing electromagnetic radiation. As mentioned, the reactances of PIN diodes 230 and 240 affect the radiation. Both the antenna radiation pattern and the radiation efficiency at a particular frequency may be controlled by control of the bias applied to diodes 230 and 240. As illustrated in FIG. 3, the bias is a direct voltage having a polarity selected to forward bias the diodes. The forward bias voltage is generated by a source of direct voltage illustrated as a battery 312 connected across a potentiometer 314 having a movable tap 316. Movement of tap 316 allows selection of any voltage up to the maximum voltage available from battery 312. Tap 316 is connected to transmission line 220 by means of a low pass filter illustrated as an inductor 318 which, as known, allows the direct bias voltage to be applied to transmission line 220 (and therefore by way of patch antenna 210 to diodes 230 and 240), but prevents or reduces leakage of millimeter wave signals from transmission line 220 into the source of bias voltage. Various types of low pass filters are known in the art, and further explanation is deemed unnecessary. Adjustment of the position of tap 316 varies the forward bias across diodes 230 and 240, thereby changing their conduction and adjusting the impedance, radiating characteristics, frequency and/or polarization of patch antenna 210. This allows frequency, polarization and direction diversity.

Figure 4:
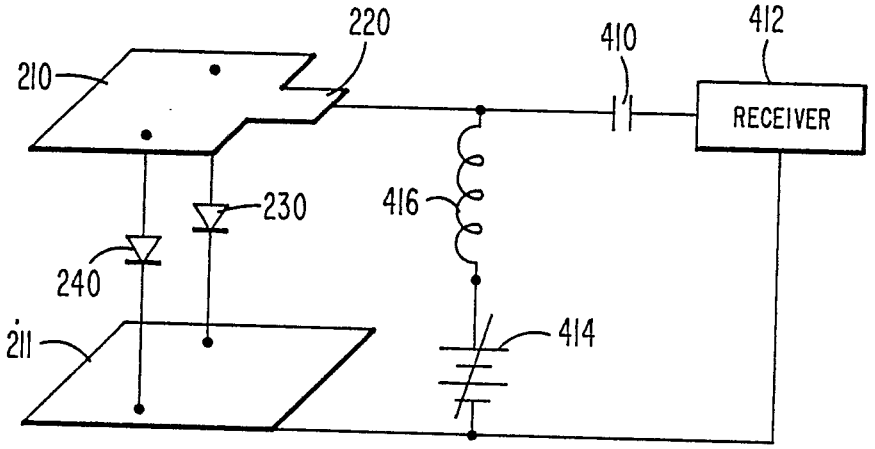
FIG. 4 is a diagram, partially in pictorial and partially in schematic form, illustrating the connections of the antenna of FIGS. 2*a* and 2*b* for use in receiving signals.

FIG. 4 illustrates, partially in pictorial and partially in schematic form, the electrical connections required to receive signals from an antenna tuned according to the invention. Elements of FIG. 4 corresponding to elements of FIG. 2a are designated by the same reference numeral. In FIG. 4, antenna 210 receives millimeter wave signals which are coupled by way of transmission line 220 and by a direct current blocking capacitor 410 to a receiver, illustrated as block 412, which may down convert the received signal, demodulate and perform other known receiver functions. A source of direct voltage bias includes a source of direct voltage illustrated as a variable battery 414 having its negative terminal electrically connected to ground plane 211 and its positive terminal connected by a low pass filter illustrated as an inductor 416 to transmission line 220. As the voltage produced by battery 414 is varied, the forward bias voltage applied by way of transmission line 220 and conductive patch 210 to forward bias diodes 230 and 240 also varies. The impedance presented to feed transmission line 220 and to receiver 412, the gain, and the receiving antenna pattern may be controlled by the application of bias voltage to diodes 230 and 240. It should be noted in this regard that it is well known that the receiving and transmitting functions of antennas are reciprocal, so that the gain, radiation pattern and impedance of a particular antenna are the same whether signal is transmitted or received. This reciprocity is often not stated, and discussion in the art is often couched only in terms of either transmission or reception alone.

Figure 5A:
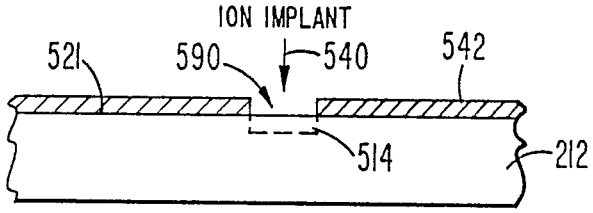
FIGS. 5*a*—5*e* are cross-sections of a semiconductor substrate during the various steps of the processing required to produce the antenna illustrated in FIGS. 2*a and 2b;*
Figure 5B:
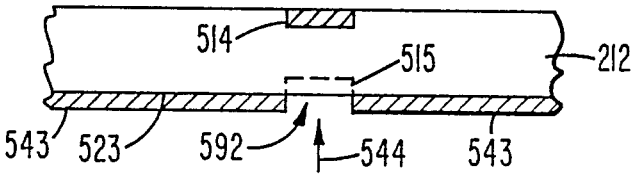

FIG. 5a–5e illustrate important steps in the fabrication of a PIN diode such as 230 or 240 of FIGS. 3 or 4. FIG. 5a illustrates the upper surface 521 of silicon substrate 212 being implanted in a region 514 having dimensions 0.6 mm×0.16 mm with a conductivity modifier, such as boron ions 540, through a photoresist mask 542 having a window 590 defining the region in which the PIN junction is desired. The boron ions create a p+doping in region 514. As shown in FIG. 5b, the opposite surface 523 of silicon substrate 212 is provided with a similar but mirror-image photoresist mask 543 defining a window 592 through which a phosphorus ion implant 544, as a conductivity modifier, is passed to develop n+ region 515. Region 515 is also implanted within an area approximately 0.6 mm×0.16 mm. Regions 514 and 515 are on directly opposed surfaces of substrate 212 and are in precise opposed mirror-image alignment.

Figure 5C:
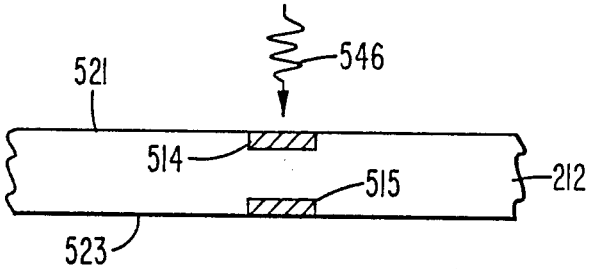
Figure 5D:
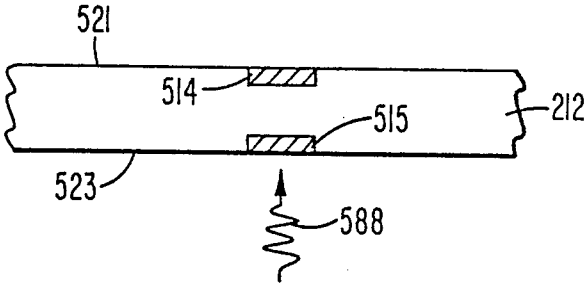

As shown in FIG. 5c, the silicon wafer 212 carrying the implanted regions 514 and 515 has its upper surface 521 pulsed-laser annealed as shown by arrow 546. The opposite surface 523 of wafer 212 on which region 515 is formed is then pulsed-laser annealed as represented by arrow 588 in FIG. 5d.

Figure 5E:
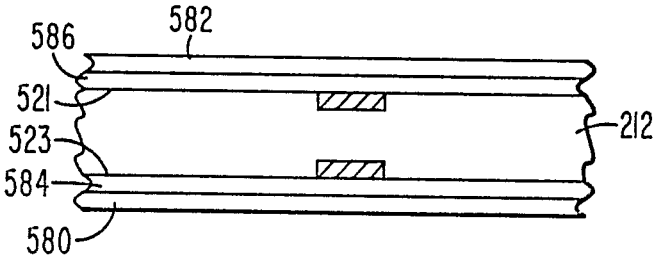

Surfaces 521 and 523 of substrate 212 are then metallized in several steps as illustrated in FIG. 5e. A layer of chromium having a thickness of 0.05 μm is first evaporated onto surface 521 to form a chromium layer 586. A 0.5 μm film of gold is then evaporated over the chromium layer. A second layer 584 of chromium having a thickness of 0.05 μm is then evaporated onto surface 523, and a 0.5 μm film of gold is then evaporated over the second chromium layer. These thin layers of gold are not separately illustrated in FIG. 5e. A layer several micrometers thick of gold is electroplated onto the evaporated gold layer to form a gold layer illustrated as 580 overlying chromium layer 584 and a gold layer 582 overlying chromium layer 586 to produce the structure illustrated in FIG. 5e.

As so far described, the PIN diodes by which the antenna is tuned are monolithic diodes having lateral dimensions roughly equivalent to those of prior art discrete diodes used for the same purpose. However, the monolithic diodes are more advantageous in that they are more repeatable during fabrication, and furthermore have significantly higher heat dissipation capabilities, and therefore are adapted for use in conjunction with transmitters having significant power. However, as mentioned in conjunction with the discussion of discrete diodes, such diodes must gather current from the surrounding area of the antenna, and therefore have significant inductance which reduces their ability to effectively short-circuit the antenna for frequency change.

Figure 6:
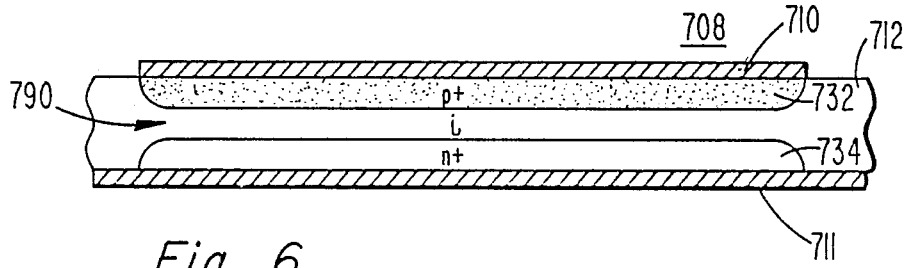
FIG. 6 is a cross-section of an antenna according to the invention using a distributed PIN diode.
Figure 7:
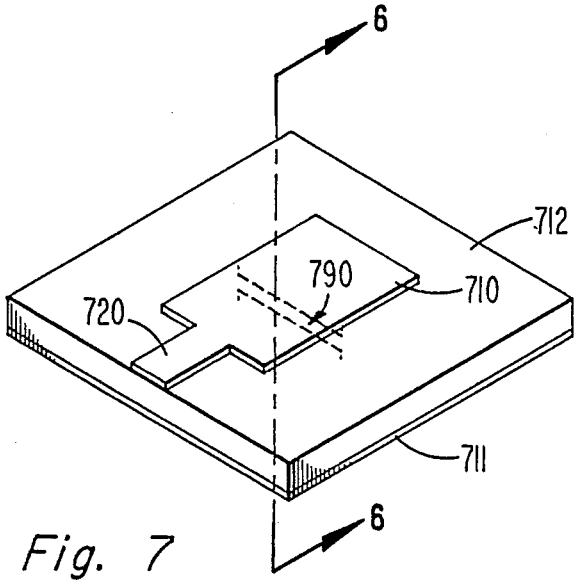
FIG. 7 is a perspective view of the antenna of FIG. 6.

FIG. 6 illustrates in cross-section a patch antenna 708 similar to patch antenna 208 of FIG. 2a. In FIG. 6, patch antenna 708 is seen in cross-section and includes a conductive patch 710 on the upper surface of a semiconductor substrate 712 having a conductive ground plane 711 which overlies the bottom surface of semiconductor substrate 712. An elongated implanted p+region 732 extends over the entirety of the width of conductive patch 710. An n+region 734 occupies a corresponding position adjacent the lower surface of substrate 712 and is separated from p+region 732 in an i region. This arrangement defines an elongated PIN diode designated generally as 790 which extends across the entire width of patch antenna 710. FIG. 7 is a perspective view of substrate 712 and associated patch antenna 710, illustrating by arrows 6—6 the direction of cross-sectional view of FIG. 6. Distributed PIN diode 790 essentially bisects the active radiating portion of patch antenna 710. When diode 790 is rendered conductive by application of forward bias, the region of patch 710 with which it is associated is short-circuited to ground plane 711 by a low-impedance path. When patch antenna 710 is fed by a strip transmission line such as conductor portion 720 of FIG. 7, the effective size of the radiating portion of the antenna is reduced, and the frequency of optimum radiation is increased. Thus, rendering PIN diode 790 conductive increases the operating frequency of the patch antenna.

Patch antennas separated from a large ground plane, such as those depicted in FIGS. 2*a* and 7, normally have linear dimensions which are approximately one-half wavelength ($\lambda/2$) in dielectric at the frequency of operation. To effect a significant short-circuit, a PIN diode preferably is distributed, with linear dimension greater than or equal to one-tenth of a wavelength ($\lambda/10$). As is known, the wavelength in a semiconductor is less than the free-space wavelength in a proportion given by $1/\sqrt{\epsilon}$, where $\epsilon$ is the relative dielectric constant. The relative dielectric constant for a silicon substrate is approximately 12, and for gallium arsenide (GaAs) is approximately 13.

A distributed PIN diode such as that illustrated in FIGS. 6 and 7 provides a short-circuit over a broad range of frequencies, unlike an array of discrete diodes spaced apart uniformly, wherein for spacings greater than $\lambda/10$, impedance transformations take place which defeat the short-circuiting. Furthermore, such a distributed PIN diode provides an extremely short path between all points on the patch antenna which lie above the diode and the associated ground plane, which therefore results in low reactance and good performance. A further advantage of the distributed PIN diode is its very large heat dissipating surface and corresponding high power capability.

Figure 8:
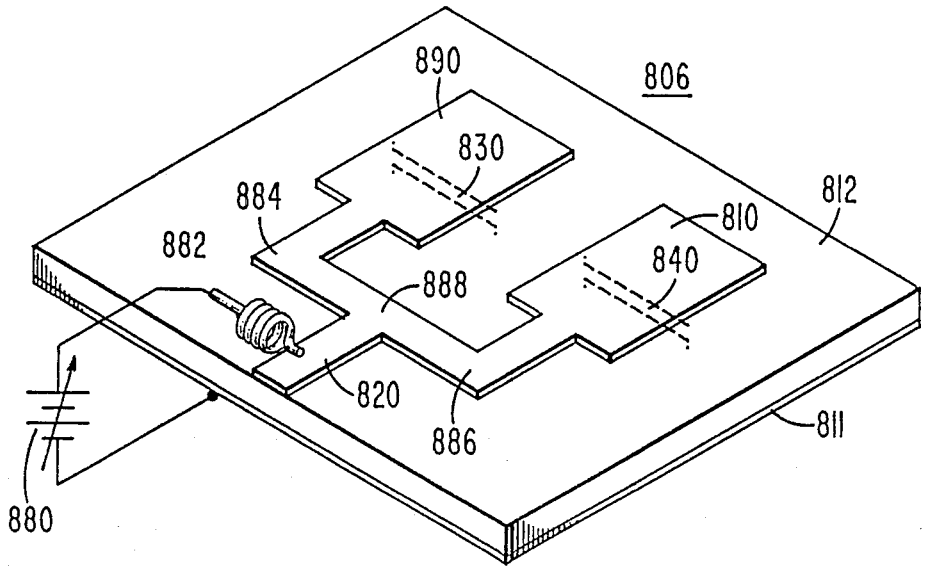
FIG. 8 illustrates the arraying of two patch antennas similar to the antennas illustrated in FIGS. 2*a* and 2*b*

FIG. 8 illustrates an array 806 of two patch antennas 810, 890 driven in common or corporately from a strip conductor 820. A ground plane 811 is attached to the entire bottom side of semiconductor substrate 812. Strip conductor 820 in conjunction with ground plane 811 forms a transmission line having a characteristic impedance. Conductor 820 divides at a point 888 into two conductors 886 and 884, which couple power from conductor 820 to patch antennas 810 and 890, respectively. The lengths and widths of conductors 886 and 884 are selected in conjunction with the impedances of the patch antennas over the frequencies of operation to insure that the parallel impedance at the junction of conductors 886 and 884 is a reasonable match to the impedance of the transmission line of which conductor 820 is a part. Perfect impedance match at all frequencies is seldom, if ever, acheived. All that is required is to have sufficient impedance match to couple sufficient signal energy between conductor 820 and antennas 810 and 890. A low pass filter represented as an inductor 882 is connected to common conductor 820 and to a source of direct voltage bias represented as a variable battery 880. As described previously, such bias allows distributed diodes illustrated in phantom as 840 and 830 to be rendered conductive or nonconductive, and for some bias voltages to have impedance which may be desirable in conjunction with radiation by array 806.

As known, phase shifters may be interposed between conductor 820 and one or both patch antennas 810, 890 for directing the peak of the radiation pattern of antenna array 806 in the desired direction. Alternatively, the relative impedances presented by patch antennas 810 and 890 may be adjusted to provide the desired phase shift for steering of the radiation pattern.

Other embodiments of the invention will be apparent to those skilled in the art. For example, a direct current bias may be used instead of a direct voltage bias. A plurality of distributed PIN diodes may be located at various points under the conductive portions of the patch antennas. Rather than an unbalanced radiating configuration including a discrete radiator and a conductive ground plane, a balanced or bilateral radiator configuration may be used, with the PIN diode or diodes connecting between the two halves of the balanced configuration. Such a balanced configuration might be, for example, a dipole element. The patch antenna may have regular geometric shapes other than rectangular, such as circular, disc, or ring, triangular, polygonal, and elliptical. Similarly, the distributed diodes may be rectangular, circular, or have a ring shape if desired. The PIN diode may be biased by the signal itself, as by self-rectification, or it may be unbiased.

What is claimed is:

1. An antenna comprising:

a substantially intrinsic flat semiconductor substrate including first and second broad sides;

a first region of said substrate adjacent said first broad side heavily doped with one of n and p donor impurities to form one of an n+ and a p+ region;

a second region of said substrate adjacent said second broad side heavily doped with the other of said n and p donor impurities to form the other of said n+and p+regions, said second region being at a location on said substrate opposite said first region, and said dopings of said first and second regions being of such a depth that intrinsic semiconductor material everywhere separates said n+ and p+ region, thereby defining a PIN diode including first and second electrodes;

a first conductive layer affixed to said first broad side of said semiconductor substrate, overlying said first region and in conductive contact with said first electrode;

a second conductive layer affixed to said second broad side of said semiconductor substrate, overlying said second region and in conductive contact with said second electrode, said first and second conductive layers being dimensioned relative to each other to define an antenna which, when energized within a frequency band, produces electromagnetic radiation in preferred directions; and bias means coupled to said PIN diode for controlling the characteristics of said PIN diode for controlling the characteristics of said antenna.

2. An antenna according to claim 1 wherein said first conductive layer is a rectangular patch having length and width which are each approximately one-half wavelength at a frequency within said frequency band, and said second conductor layer has an area four or more times greater than that of said patch thereby defining a ground plane.

3. An antenna according to claim 2 further comprising an elongated conductor layer affixed to said first broad side of said semiconductor substrate, said elongated conductor layer being attached at one end thereof to the center of a side of the periphery of said rectangular patch thereby defining in conjunction with said second conductive layer a transmission line for providing coupling between said antenna and utilization means.

4. An antenna according to claim 3 wherein said bias means further comprises:

a source of direct voltage; and means for coupling said source of direct voltage to said elongated conductor layer and to said second conductive layer for applying said direct voltage to said PIN diode by way of said elongated conductor layer and said first conductor layer, and for preventing signals within said frequency band from reaching said source of direct voltage from said elongated conductor layer.

5. An antenna according to claim 1 wherein said bias means coupled to said PIN diode further comprises:

a source of direct voltage coupled to said first and second conductive layers for applying a bias voltage to said PIN diode for one of forward and reverse biasing said PIN diode.

6. An antenna according to claim 1 wherein said substrate is formed from silicon.

7. An antenna according to claim 1 wherein said substrate is formed from gallium arsenide.

8. An antenna according to claim 1 wherein:

said first conductive layer is a patch having a predetermined surface area;

said second conductive layer has a surface area at least four times that of said predetermined surface area and therefore acts as a ground plane; and said first and second regions over which said PIN diode extends each have linear dimensions equal to or greater than one-tenth of a wavelength.

* * * * *